US005885660A

United States Patent [19]

Ruschak et al.

[11] Patent Number: 5,885,660

[45] Date of Patent: Mar. 23, 1999

[54] COATING SURFACES WITH A FREE FALLING COATING COMPOSITION, USING A BASIN WITH A WALL DIVIDING THE BASIN INTO TWO CHANNELS

[75] Inventors: Kenneth J. Ruschak, Rochester; Rukmini B. Lobo, Webster; Barry A. Fitzgerald, Holley, all of N.Y.; Richard A. Gilkey, Greeley, Colo.; David A. Wakefield, Canandaigua, N.Y.

[73] Assignee: Eastman Kodak Company, Rochester, N.Y.

[21] Appl. No.: 10,671

[22] Filed: Jan. 22, 1998

[51] Int. Cl.[6] ..... B05D 1/30; B05C 5/00

[52] U.S. Cl. ..... 427/420; 118/324; 118/DIG. 4

[58] Field of Search ..... 427/420; 118/324, 118/DIG. 4

[56] References Cited

U.S. PATENT DOCUMENTS

| | | | |
|---|---|---|---|
| 2,745,419 | 5/1956 | Slingerland | 134/130 |
| 3,067,060 | 12/1962 | Glaus | 117/102 |
| 3,074,374 | 1/1963 | Burkle | 118/324 |
| 3,205,089 | 9/1965 | Kinzelman | 117/105.3 |
| 3,345,972 | 10/1967 | Masulis | 118/301 |
| 3,365,325 | 1/1968 | Fraenkel | 117/105.3 |
| 3,632,374 | 1/1972 | Greiller | 117/34 |
| 3,717,121 | 2/1973 | Bruckbauer et al. | 118/324 |
| 3,876,465 | 4/1975 | Prazak, III | 117/33.5 C |
| 3,930,465 | 1/1976 | Schuierer | 118/325 |
| 4,060,649 | 11/1977 | Coleman | 118/DIG. 4 |
| 4,075,976 | 2/1978 | Clayton | 118/324 |
| 4,230,743 | 10/1980 | Nakamura et al. | 427/146 |
| 4,384,015 | 5/1983 | Koepke et al. | 427/402 |
| 4,427,722 | 1/1984 | Keller | 427/420 |
| 4,466,993 | 8/1984 | Hsu et al. | 118/264 |
| 4,830,887 | 5/1989 | Reiter | 427/420 |
| 5,298,288 | 3/1994 | Curry, II et al. | 427/379 |
| 5,328,726 | 7/1994 | Reiter | 427/420 |
| 5,395,660 | 3/1995 | Ruschak et al. | 427/420 |
| 5,399,385 | 3/1995 | Joos et al. | 427/420 |
| 5,462,598 | 10/1995 | Servant et al. | 118/324 |
| 5,681,389 | 10/1997 | Lobo et al. | 118/DIG. 4 |

FOREIGN PATENT DOCUMENTS

| | | | |
|---|---|---|---|
| 51-7697 | 3/1976 | Japan | 118/DIG. 4 |
| 5-337432 | 12/1993 | Japan | 427/420 |
| 478624 | 10/1975 | U.S.S.R. | 118/DIG. 4 |
| 694223 | 10/1979 | U.S.S.R. | 118/DIG. 4 |

*Primary Examiner*—Katherine A. Bareford
*Attorney, Agent, or Firm*—Arthur H. Rosenstein

[57] ABSTRACT

An apparatus for coating surfaces consists of a basin, open to the atmosphere, divided into two channels by a wall running perpendicular to the coating direction. Liquid is supplied to the primary channel, the channel farther from the curtain. A continuous, adjustable gap between the dividing wall and the bottom of the basin offers resistance to flow but passes the coating composition from the primary to the secondary channel. The secondary channel has an edge that is horizontal and relatively low so that the coating composition overflows it to form a free-falling curtain. The dividing wall, by providing flow resistance, assists in distributing the supplied coating composition along the length of the primary channel, and reduces any flow disturbances caused by the entering coating composition. The secondary channel promotes additional evening of the flow distribution before the curtain forms.

11 Claims, 6 Drawing Sheets

COATING SURFACES WITH A FREE FALLING COATING COMPOSITION, USING A BASIN WITH A WALL DIVIDING THE BASIN INTO TWO CHANNELS

FIELD OF THE INVENTION

The invention relates to a coating apparatus and method or to a feed for a coating apparatus and method. More particularly, the invention concerns the creation of a free-falling curtain of a single coating composition that is highly uniform in flow rate for application to a moving surface or web.

BACKGROUND OF THE INVENTION

A common way to apply coatings to moving surfaces is to create a free-falling curtain of coating composition and to pass the surface to be coated through the curtain. FIG. 1 *a, b* and *c* show examples of curtain coating means of the prior art. In some applications, such as the painting of objects, the uniformity of the coating is not critical. In such cases, simple and inexpensive means known in the art can be used to form the curtain. For example, a weir can be used. The weir can be a basin having a relatively low edge along which the coating composition overflows to form a curtain. The coating composition is pumped or poured into the basin. If the overflowing edge is horizontal, and if the basin is wide and deep, a uniform curtain is created.

However, a large basin can have disadvantages. The size required to ensure a uniform curtain may exceed available space. A large basin may require thick walls or a sturdy platform to prevent mechanical sagging due to weight. In some operations, it may not be practical to recover the coating composition remaining in the basin at the completion of a production run; in this case, the larger the volume of the basin, the greater the loss of possibly expensive coating composition. A large basin also has regions where the coating composition is nearly stagnant. Gravitationally induced inhomogeneities of the coating composition can occur in stagnant regions if the coating composition is a dispersion or suspension of one phase in another of a different density; examples include silver grains in aqueous gelatin and matte particles in a liquid. A large basin is also subject to eddies or regions of flow recirculation. Stagnation zones where recirculations meet are particularly susceptible to gravitationally induced inhomogeneities. Inhomogeneities in the coating composition can produce visual or functional nonuniformities in the coating such as streaks.

However, reducing the volume of the basin while maintaining widthwise uniformity entails difficulties. As the cross section of the basin becomes smaller, the hydrodynamic resistance to flow in the direction of the width of the curtain increases; gravitational leveling may become incomplete, and where the level is higher, the curtain will have a higher flow rate. Similarly, the disturbing effects of the incoming liquid may not completely dissipate before the curtain forms in a basin of small cross section. One such disturbance is the jetting of the coating composition into the basin when it is introduced through a conduit or poured from a nozzle.

The following U.S. Pat. Nos. describe coating apparatus useful in curtain coating: 2,745,419; 3,067,060; 3,074,374; 3,205,089; 3,345,972; 3,365,325; 3,632,374; 3,717,121; 3,876,465; 4,060,649; 4,075,976; 4,230,743; 4,384,015; 4,427,722; 5,298,288.

Ways are known in the art to preserve flow uniformity while reducing the cross section of the distributor. One way, shown in FIG. 1*a,* is to feed the basin from a conduit with numerous holes spanning the coating width; however, the multiple, discrete streams promote areas of recirculation and stagnation in the basin. Another way, shown in FIG. 1*b,* is to employ an extrusion die having a distribution cavity and narrow slot through which the liquid is forced. If the flow resistance over the length of the slot is large compared to that over the length of the cavity, the liquid is distributed across the die. In the most demanding applications, two or more cavity/slot combinations are employed in series. The effectiveness of the die also depends on the rheological properties of the coating composition. The narrow slot of the die subjects a non-Newtonian coating composition to high rates of shearing where pseudoplasticity or viscoelasticity become complicating performance factors. So, a different die may be required for each product, or a means of adjusting the die geometry may be required, such as tailoring the height of the slot by applying an adjustable mechanical loading. Major disadvantages of an extrusion die are its mechanical complexity, tight fabrication tolerances, and resulting high cost.

FIG. 1*a* of the drawings is a weir for forming a curtain according to prior art (Method and Apparatus for Flow Coating Objects, J. Kinzelman, U.S. Pat. No. 3,205,089 issued Sep. 7, 1965). The weir consists of a single channel. Coating composition is delivered to a conduit running through the channel. The conduit has a series of holes along its length to feed the coating composition to the channel.

FIG. 1*b* is a die forming a curtain according to prior art (Coating a Heat Curable Liquid Dielectric on a Substrate, Curry, II et al; U.S. Pat. 5,298,288 issued Mar. 29, 1994). Inside the die is at least one distribution cavity connected to the inlet and spanning the width of the curtain. The curtain is extruded from a narrow slot adjoining the distribution cavity and spanning the width of the curtain.

FIG. 1*c* in the drawings shows another weir for forming a curtain according to prior art (Paint Curtain Machine and Method of Painting, J. H. Coleman, U.S. Pat. No. 4,060,649, Nov. 29, 1977). In this case the weir is simply a large basin.

SUMMARY OF THE INVENTION

The invention provides an inexpensive and versatile apparatus for creating a highly uniform curtain of a single coating composition for the purpose of coating surfaces. In particular, the invention achieves low holdup volume, flow patterns resistant to gravitationally induced coating nonuniformities, and insensitivity to the rheology of the coating composition.

By holdup volume is meant the volume of liquid contained within the curtain-forming apparatus, i.e. the basin (two-channel weir). When a coating is terminated, the weir contains this volume of coating composition. The coating composition cannot always be recycled, and so the holdup volume is potential waste. If the coating composition is solvent based and its vapors in air potentially explosive or toxic, the weir should be drained quickly. For these and other reasons mentioned in the specification, it is desirable to minimize the holdup volume.

Accordingly, an object of the invention is to provide an inexpensive method and apparatus for creating a highly uniform curtain of a single coating composition for the purpose of coating surfaces without the large volume and stagnant or recirculating flow patterns of the simple weir or the expense and complexity of the extrusion die. In particular, the invention achieves at low cost a small holdup volume and short residence time. It is a further object of the invention to provide a simple, inexpensive, and rapid way to accommodate different flow conditions and fluid properties. Further objects and advantages of the invention will become apparent from a consideration of the drawings and ensuing descriptions.

The invention consists of a basin divided into two channels by a wall spanning the coating width. Liquid is supplied to the primary channel, the channel farther from the curtain. The dividing wall is gapped to the bottom of the basin to pass the liquid from the primary to the secondary channel while providing some resistance to flow. The gap can be on the order of 0.1 inch and is several times larger than that used for extrusion dies. As a result, the shear rate to which the coating composition is subject is relatively low and non-Newtonian effects are minimized. In alternative embodiments, the dividing wall is perforated or porous instead of gapped from the bottom of the basin. The secondary channel has an edge configured as a pouring lip that is horizontal and relatively low so that the coating composition overflows it to form a free-falling curtain. The basin should overflow only at the lip where the free falling curtain forms. The side and back walls of the basin should have top edges higher than the lip to contain the liquid. Similarly, the top edge of the dividing plate should be high enough to contain the liquid during normal operation but low enough to overflow before the side and back walls in case of accidental flooding. The flow resistance created by the dividing wall is typically such that the drop in the level of the coating composition across the dividing wall is on the order of one centimeter. The flow resistance created by the dividing wall assists in distributing the supplied coating composition over the width of the curtain channel and diminishes any flow disturbances associated with the entering coating composition. The secondary channel promotes additional evening of the flow distribution before the curtain forms. A highly uniform flow distribution is indicated by a substantially level surface of the liquid in the secondary channel.

Preferably, the coating composition is supplied through a conduit feeding the center of the primary channel. In a preferred embodiment of the invention, an inlet is provided inside the primary channel to break up the jet from the conduit and direct the liquid toward the ends of the primary channel. The inlet also ensures that the velocity of the liquid is nearly constant over the cross section of the primary channel so that regions of stagnation and recirculation are avoided. The high, uniform velocity of the liquid from the inlet propels the coating composition to the cavity ends and so promotes a uniform flow distribution.

More preferably, the coating composition is supplied to the center of the primary channel through a conduit. A centrally located feed minimizes the distance over which the coating composition is distributed and creates a symmetry favoring the effectiveness of the secondary channel at evening the flow distribution; any variation in flow rate entering the secondary channel is symmetric about the center and evening the distribution requires flow over just half of the coating width. In the preferred embodiment of the invention, an inlet is added to the primary channel to break up jetting from the supply conduit and direct the liquid towards the ends of the primary channel. The inlet propels the coating composition to the ends of the weir. The initial kinetic energy greatly reduces the gravitational head that would otherwise be expended in driving the flow down the channel. A nearly constant depth in the primary channel promotes uniform flow into the secondary channel. The inlet also ensures that the velocity of the liquid is nearly constant over the cross section of the primary channel so that regions of stagnation and recirculation are avoided.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

Figure 1A:
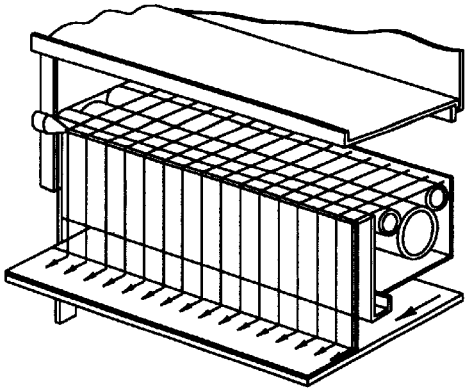
FIG. 1A (PRIOR ART)
FIG. 1*a,* 1*b,* and 1*c* shows the creation of the curtain using weir and die means of the prior art.
Figure 1B:
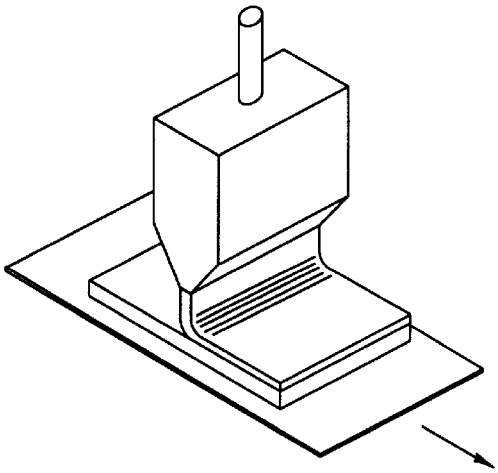
FIG. 1B (PRIOR ART)
Figure 1C:
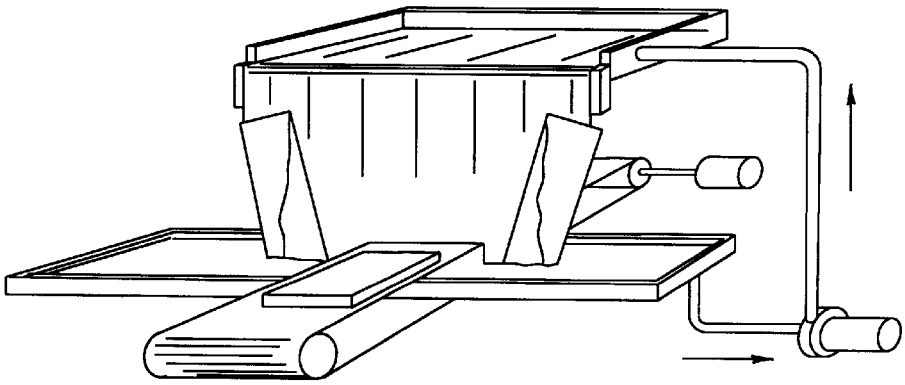
FIG. 1C (PRIOR ART)
Figure 2:
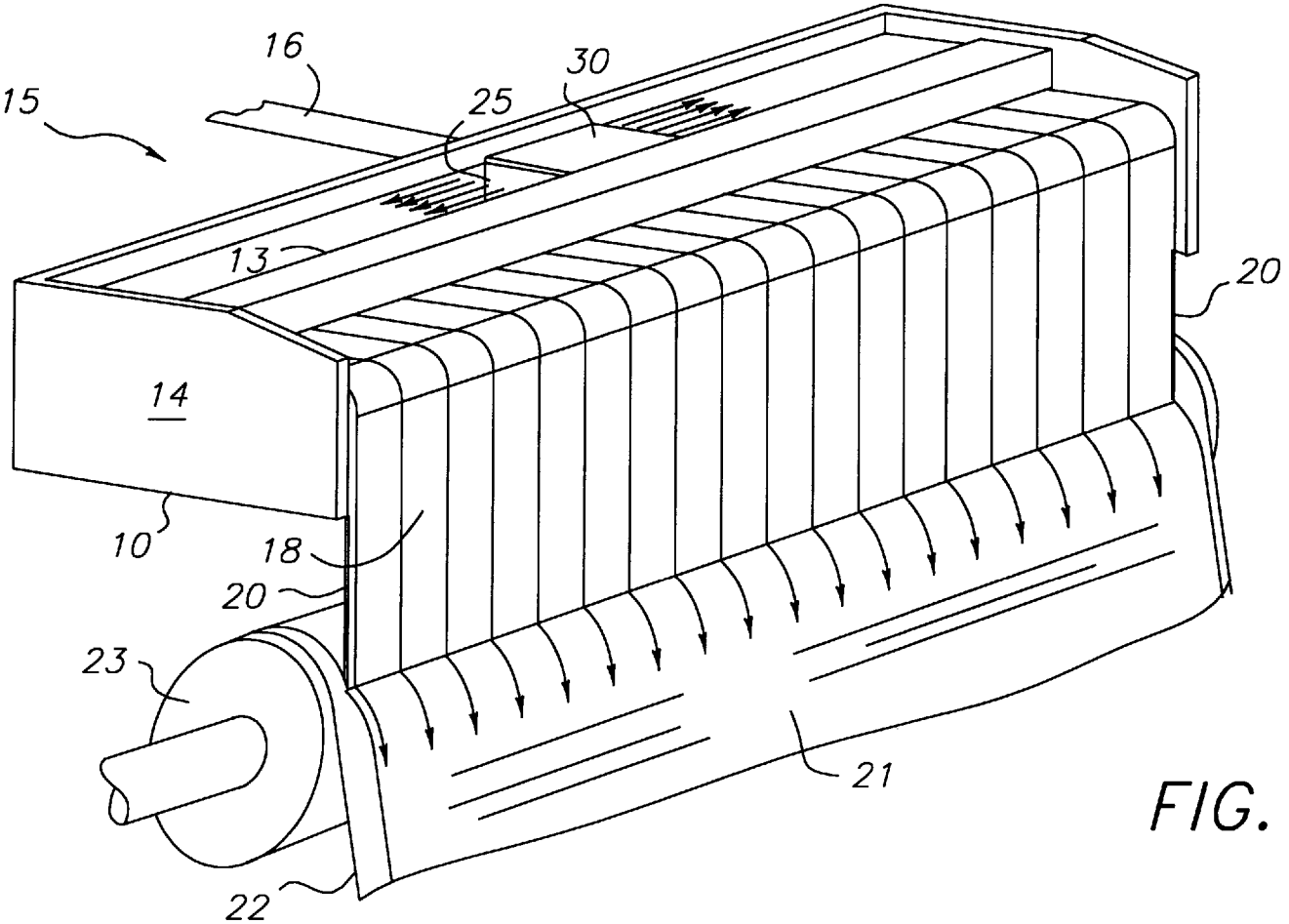
FIG. 2 is a schematic, three-dimensional view of the weir apparatus of the invention.

The preferred embodiment of the invention for forming a uniform curtain for application to a receiving surface is shown in FIG. 2. The apparatus consists of a basin 10 divided into a primary channel 11 and a secondary channel 12 by dividing plate 13. The basin has two end caps 14 that determine its lateral extent. Replaceable endcaps of various lateral dimension may be used to change the width of the coating. The basin has an inlet end 15 where coating composition is supplied to the primary channel. The inlet has the following essential elements:

a) a port to receive the coating composition from the conduit. The supply conduit should be in a vertical plane that is perpendicular to the curtain at the center of the width of the curtain;

b) the inlet itself is an enclosure (box) centered on this port and filling the cross section of the primary channel from the backwall of the basin to the dividing plate. The top, bottom, front and back sides of the inlet enclosure are solid. The sides of the inlet enclosure consist of one or more layers of perforated plate lying in vertical planes perpendicular to the curtain. Coating composition exits the sidewalls in the direction of the axis of the channel and is distributed evenly over the cross section of the channel;

c) preferably, the outermost perforated plate of the sidewall is corrugated so that the open area of this plate is at least 50% of the cross-sectional area of the primary channel. The corrugations are symmetric about lines and planes parallel to the axis of the channel such that components of lateral flow (flow perpendicular to the axis of the channel) from the corrugations cancel one another.

d) optionally, the front plate of the inlet enclosure is gapped from the dividing wall and perforated.

In FIG. 2, coating composition is supplied through a conduit 16 to the center of the primary channel. An inlet 25 within the primary channel directs the liquid along the axis of the primary channel. The coating composition flows along the primary channel towards the end caps 14 because of its momentum in that direction from the inlet and because of gravitational leveling. When the momentum is significant, little or no drop in liquid level occurs from the center to the ends of the primary channel. A nearly uniform level in the primary channel favors uniform flow into the secondary channel.

There are other, less advantageous ways in which the primary channel can be supplied with coating composition. A supply conduit can be located at other lateral positions or at an end of a channel, and multiple supply conduits can be distributed widthwise. The supply conduit can run through the primary channel from end cap to end cap and supply coating composition through numerous holes. The coating composition can be poured into the primary channel at one or more positions.

The dividing wall 13 creates a resistance to flow from the primary channel to the secondary channel. This resistance promotes the distribution of the coating composition along the primary channel and diminishes any disturbances associated with the entry of the coating composition. The dividing wall is a critical element of the invention, and it is described in detail below.

Figure 3:
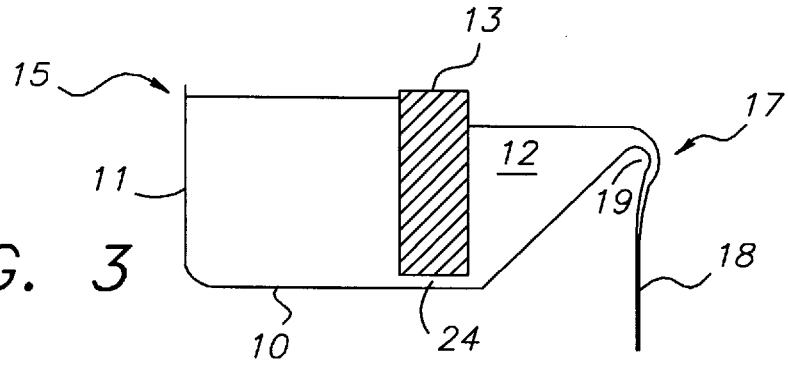
FIG. 3 is a vertical cross section through the weir showing the dividing wall.

As shown in FIG. 3, the coating composition entering the secondary channel 12 from the primary channel 11 flows primarily across the secondary channel to an outlet end 17 of basin 10. The outlet end 17 is configured as a horizontal pouring lip that the coating composition overflows to form a free falling curtain 18. The overflow may simply take place over a horizontal edge of the basin. Preferably, however, the outlet end of the basin is a lip 19 contoured to direct the coating composition vertically downward. Lip configurations conducive to forming a free falling curtain are known in the art; for example, U.S. Pat. Nos. 5,462,598 and 5,399,385. The pouring edge or lip must be lower in elevation than the end caps, the back wall of the basin, and the dividing wall so that the coating composition overflows only there. The pouring edge or lip should be accurately horizontal to promote a uniform curtain.

It is well known in the art that if the edges of a free-falling curtain are not supported by vertical edge guides, the curtain narrows as it falls because surface tension causes the edges of the curtain to roll up. Edge guides 20 can be employed to support surface tension and maintain the width of the free-falling curtain. In some applications, particularly when the curtain is wider than the receiving surface, the narrowing of the curtain is not objectionable. In most cases, however, maintaining the width of the curtain is desirable, and the edge guides known in the art can be used; for example, U.S. Pat. Nos. 4,830,887, 5,328,726, and 5,395,660.

Curtain height can vary from a few to several tens of centimeters. Generally, higher curtains promote increased coating speed without the entrainment of air between the coating and the receiving surface. For high flow rates or low viscosities, the receiving surface is advantageously tilted forward to preclude the formation of a puddle at the line of impingement. In FIG. 2 the receiving surface for the coating 21 is a web 22 conveyed through the curtain by a backing roller 23, but many other receiving surfaces are possible. As another example, the receiving surface may consist of discrete objects on a conveyor belt. The receiving surface may also be the surface of a roller used to supply a roll coating process with coating composition, or a gravure cylinder that is subsequently bladed and contacted with a web.

Figure 4:
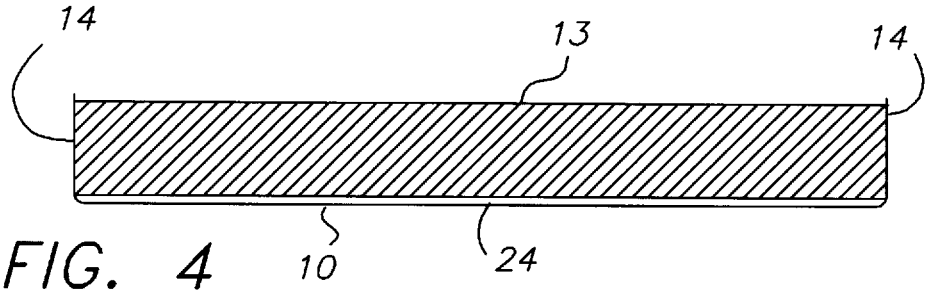
FIG. 4 is a vertical section through the dividing wall showing the continuous gap between the dividing wall and the bottom of the basin.

The dividing wall allows coating composition to pass from the primary to the secondary channel while providing some resistance. Resistance is indicated by a drop in the elevation of the surface of the coating composition between the primary and secondary channels. Preferably, as shown in FIGS. 3 and 4, there is a continuous gap 24 between the dividing wall 13 and the basin 10. The length and height of this gap determines the flow resistance. In the examples, the gap is 0.11 inches. The gap depends upon the flow rate and the properties of the coating composition. In practice, the gap is reduced until the level of the surface in the primary channel is higher than the level in the secondary channel by a distance of the order of a centimeter. The gap is readily altered by raising or lowering the dividing wall by its ends. Besides the ease in adjusting flow resistance, the gapped dividing wall precludes the regions of stagnation and flow recirculation caused by a discontinuous flow path. The gapped dividing wall also helps to exclude large air bubbles from the coating. To reach the curtain, bubbles must be drawn under the dividing wall against their buoyancy.

The gapped dividing wall also provides the option of varying the flow resistance across the width of the coating. The bottom of the wall may be contoured so that the gap varies along the length of the channels as desired, as shown in FIG. 4. Alternatively, the thickness of the wall may be contoured. The gap can also be altered by applying an adjustable mechanical load to the dividing wall so that it bends. Reasonable mechanical loads can be achieved through choice of construction material, or by designing the wall to weaken it structurally.

Figure 5:
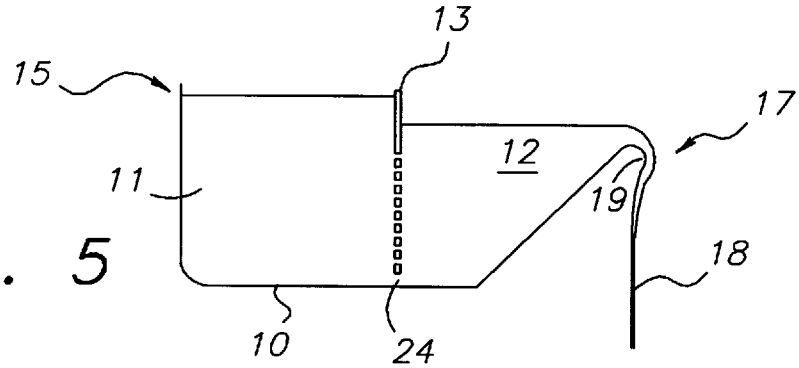
FIG. 5 shows a dividing wall of perforated plate.

Although a continuous gap is preferred, the dividing wall 13 might alternatively be made of perforated or drilled plate, as shown in FIG. 5. The holes can have any cross sectional shape although a circular shape is most common. Flow resistance is controlled primarily by the open area of such plates. A wall that is porous is the extreme of a wall with perforations. A perforated wall can be effective at laminarizing the flow and promoting a smooth curtain; large turbulent eddies are broken down into smaller eddies that rapidly dissipate. However, walls with multiple passageways can create a three-dimensional flow field that is conducive to regions of stagnation and recirculation. Part or all of the dividing wall may be perforated. The wall is perforated by drilling or punching, and most commonly the cross section of a perforation is circular. The diameter of the perforations should be small enough to provide flow resistance but large compared to any particulates dispersed in the coating composition and large enough for the drilling and punching operation; for example, a suitable diameter may be about 0.1 inch. The size and spacing of the holes is determined so that, for the desired coating composition and flow rate, the level of the surface of the liquid in the primary channel is higher than the level in the secondary channel by a distance on the order of a centimeter.

Figure 6:
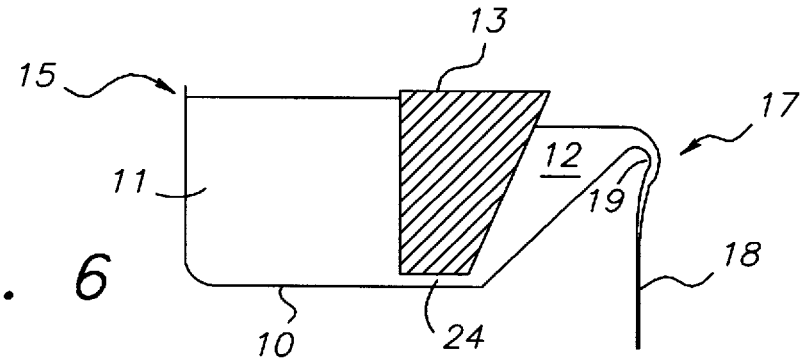
FIG. 6 shows a dividing wall shaped so as to reduce flow stagnation and recirculation in the secondary channel.

In a preferred embodiment, the basin and dividing wall can be contoured to reduce regions of stagnation and recirculation in the secondary channel. The dividing wall is preferably of cylindrical shape (the surface is traced by a straight line moving parallel to a fixed straight line and intersecting a fixed planar closed curve). As FIG. 3 shows, the wall of the basin at the outflow end 17 is preferably angled upward from the dividing wall to avoid a corner. As an additional measure, the dividing wall can be shaped so as to reduce the angle at which the flow expands in the secondary channel, as shown in FIG. 6. The smaller the angle of divergence of the flow, the less likely flow recirculations will be encountered. As is well known in hydrodynamics, the larger the Reynolds number, the more likely flow separation and turbulence will occur. The preferred Reynolds number for the coating composition is between 0.1 and 10.

As a safety feature, it is preferred that the height of the edges of the basin, except for the edge where the liquid overflows to form the curtain, exceed the elevation of the top surface of the dividing wall. Then, should the resistance of the dividing wall be too high, as by incorrect setting of the gap, or should the flow rate supplied surge for whatever reason, the liquid will overflow only the dividing wall and remain confined to the basin.

Figure 7:
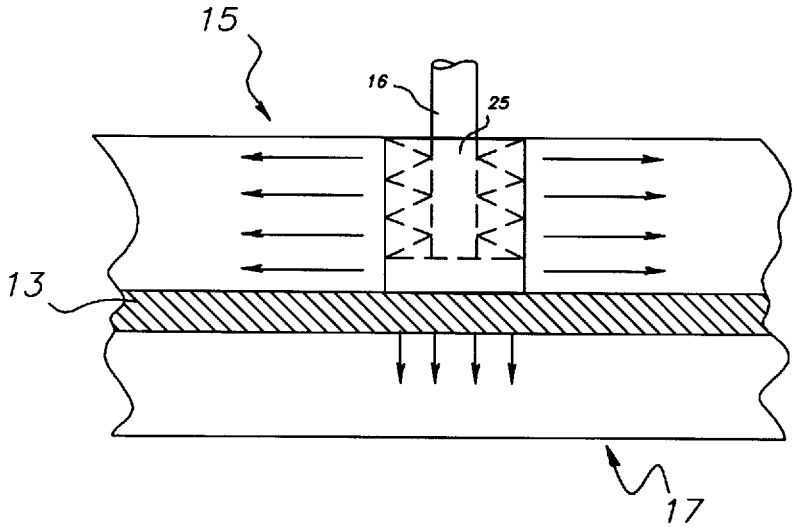
FIG. 7 shows a view of the inlet from above.

In a preferred embodiment of the invention, the primary channel has a centrally located inlet 25 that receives the incoming coating composition and directs it along the length of the primary channel. To avoid areas of stagnation and recirculation, the velocity from the inlet should be nearly uniform over the cross section, as FIG. 7 suggests.

Figure 8A:
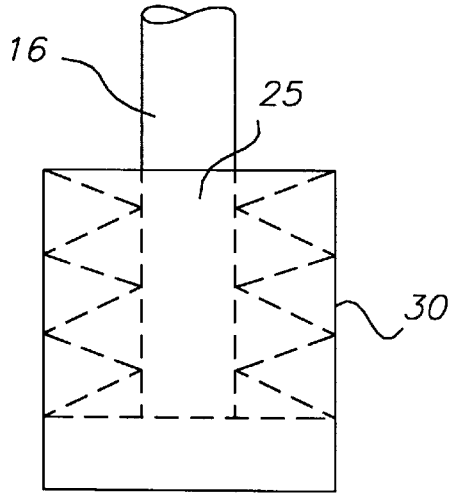
FIG. 8 shows enlarged views of the inlet from above (a), from the side (b), and from the front (c).

A central location for the inlet is preferred because this minimizes the distance over which the coating composition flows. Gravitational leveling of the liquid in the primary channel promotes a uniform distribution over the width of the coating. However, the differences in depth that drives the liquid along the primary channel, the variation in the so called gravitational head, also drives liquid into the secondary channel through the flow resistance of the dividing wall. Thus, minimizing the depth variation in the primary channel is advantageous. A way to accomplish this consistent with the object of minimizing the volume of liquid in the basin is to create an inlet that propels the liquid towards the end caps 14 of the basin. In this case, the momentum of the incoming liquid partially or completely counteracts viscous flow resistance, and less of a variation in gravitational head is required. This ideal condition is reached if a Reynolds number appropriately defined for the primary channel is of the order of magnitude of unity so that the momentum of the incoming liquid is just sufficient to convey the liquid to the ends of the primary channel.

$$Re = 0.1\,\frac{\rho q}{\mu} \quad \text{(Reynolds number)}$$

wherein:

ρ is the density of the coating composition $\mu$ is the viscosity of the coating composition q is the volumetric flow rate per unit of curtain width An effective inlet 25 has been found to be an enclosure with the walls opposite the endcaps of the basin 14 made of perforated plate. The supply conduit 16 is directed perpendicular to the lengthwise axis of the primary channel. The perforated side walls 27 are perpendicular to this axis so that the issuing liquid is directed toward the end caps of the basin. Flow resistance through the side walls distributes the liquid over the cross section of the channel. Ideally, the average velocity through the side walls based on the total open area of the perforations should approximate an average velocity based on the cross-sectional area of the primary channel. However, if the side walls are planar, the total area of all perforations must be substantially less than the channel area and the issuing velocity higher than desired. The open area of the sidewalls can be increased if their shape is corrugated rather than planar. Bends of 45 degrees, for example, increase the open area by about 41%. A section of sidewall that is slanted to the axis of the primary cavity produces an undesirable flow component across the cavity, and so it is desirable that for each slanted section there is an opposing section of equal area so that by symmetry there is no net cross flow. Bending the sidewalls to the shape of a bellows is a practical way to achieve the desired symmetry. Sidewalls of this shape are depicted in FIG. 8*a* and *b*.

Most advantageously, the sidewalls 27 of the inlet comprise a flat perforated plate in series with a perforated plate with angled, opposing sections. The flat plate is nearer the supply conduit, and its high flow resistance distributes the incoming liquid over the cross section. The plate comprising bent sections with a total open area more nearly that of the cross section of the primary cavity follows to reduce the velocity.

Figure 8B:
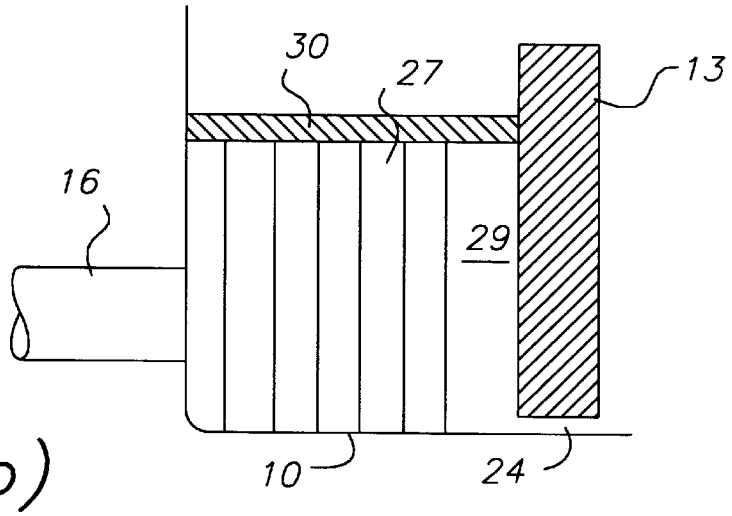
Figure 8C:
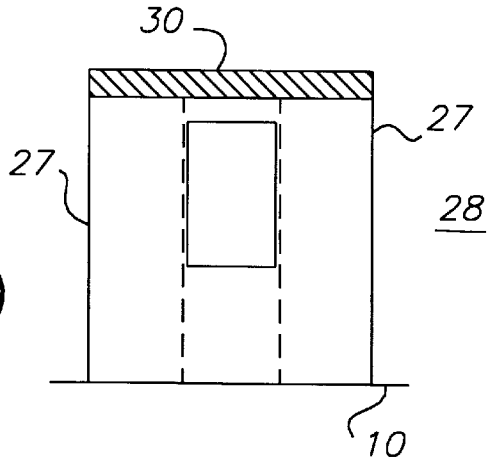

The front wall 28, shown in FIG. 8*c*, of the inlet opposing the dividing wall 13 is preferably separated from the dividing plate by a gap 29 (FIG. 8*b*) so that flow under the dividing plate is not blocked by the inlet. In the following example, the gap is 0.12 inches. The front wall of the inlet may have holes so that sufficient flow issues to supply that fraction of the cross section of the primary channel occupied by gap 29. The top surface 30 of the inlet extends to the dividing wall so that the liquid issuing from front wall 28 is forced under the dividing wall and down the primary channel. Any holes in the front wall of the inlet are preferably above the gap 24 between the dividing plate and the bottom of the basin so that direct jetting under the wall does not occur.

Figure 9:
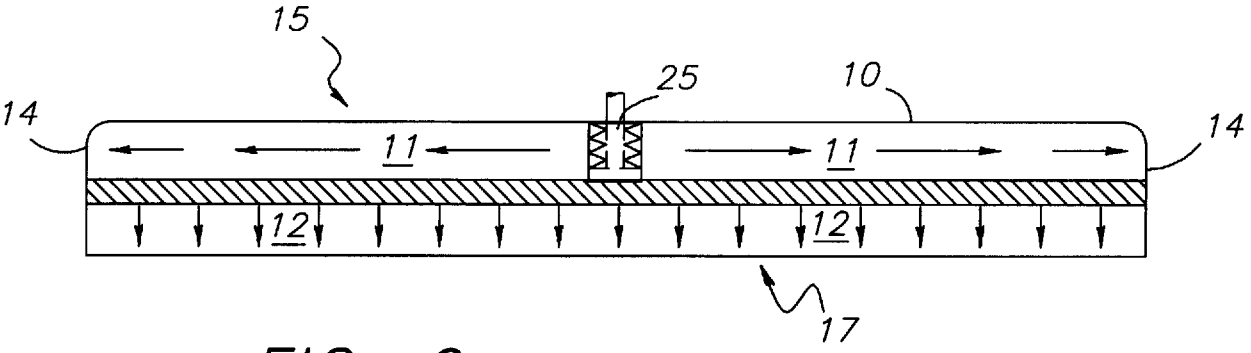
FIG. 9 shows the drop in velocity in the primary channel when the cross section is uniform.
Figure 10:
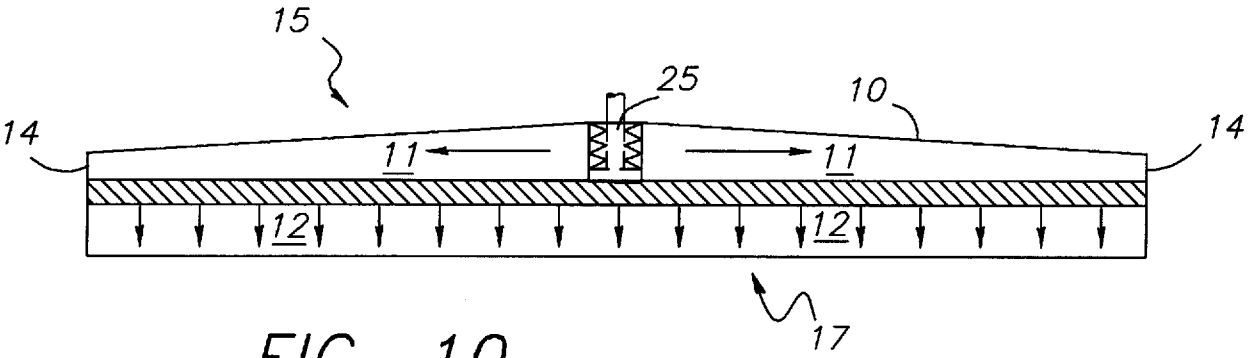
FIG. 10 shows the uniform velocity in the primary channel when the cross section is linearly tapered.

For uniform flow distribution, the flow rate through a cross section of the primary channel decreases approximately linearly with distance from the center as liquid supplies the curtain. So, if the primary cavity has a constant cross-sectional area, the velocity of the liquid in the primary cavity falls off as the end caps 14 are approached, as FIG. 9 illustrates. In FIG. 9, arrows in the primary channel indicate the average velocity and direction of the coating composition. The length of the arrows is proportional to the speed, and so the arrows indicate that the coating composition slows down as it flows from the center to the end of the primary channel. Low velocities may promote gravitationally induced inhomogeneity of the coating composition. The velocity of the liquid may be kept more uniform by tapering the cross-sectional area of the primary channel from the inlet to the cavity end, as shown by FIG. 10.

The geometric simplicity of the weir lends itself to economic fabrication. The weir may be assembled from separately machined elements, for example a main body and two endcaps, in the most demanding applications where tight tolerances must be met. In somewhat less demanding applications, the main body can be extruded from materials such as aluminum and cut to length. For the best demanding applications, the main body can be inexpensively formed from sheet material such as stainless steel sheet. Similarly, the dividing wall can be machined, extruded, or formed. A long dividing wall of small cross section can be mechanically stabilized with clips or brackets between the top of the dividing wall and the back (inlet) wall of the main body; positioning elements immersed in the coating composition disrupt flow and are undesirable. The endcaps can be replaced to vary curtain width, or blocks of different thicknesses conforming to the cross-sectional shape of the channels can be inserted into the secondary channel or into both of the channels and attached to a permanent endcap. If the inlet does not have its own floor or backwall so that the floor and back wall of the main body of the weir complete the inlet enclosure, then a tight fit is essential to prevent jetting of the coating composition through inadvertent gaps. Particularly undesirable is jetting along the floor of the weir directed under the dividing wall. In some applications, such as for highly volatile coating composition, a cover for the weir is beneficial.

EXAMPLE 1

Figure 11:
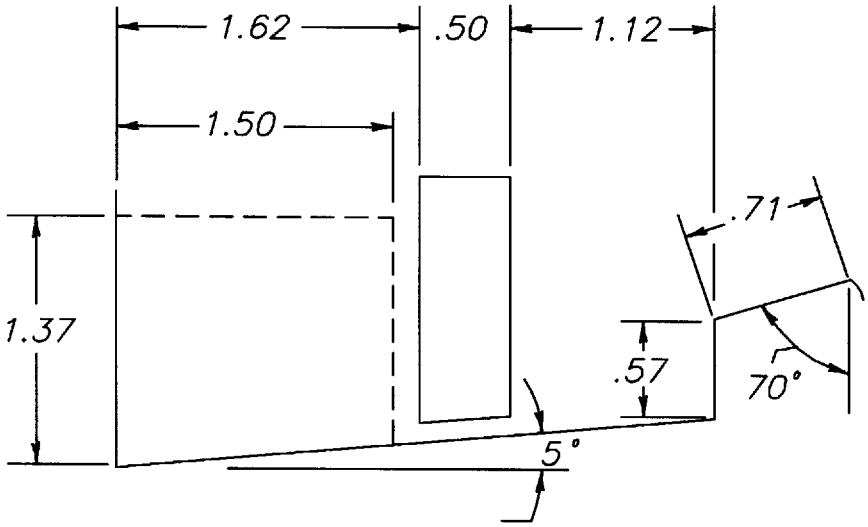
FIG. 11 shows the dimensions of the cross section of the weir of the Example.

A two-channel weir was constructed with the cross-sectional dimensions given in FIG. 11. Lengths are given in inches and angles in degrees. The gap under the dividing plate was 0.11 inches. The length of the two channels was 71 inches. The inner perforated sidewall of the inlet had holes 0.062 inches in diameter and a fractional open area of 30%. The outer perforated plate of the inlet had holes 0.075 inch in diameter and a fractional open area of 0.51; the six sections of this plate were angled at 60° to the cross section so as to oppose one another. A test liquid of polyvinyl pyrrolidone in water was prepared to which surfactant was added as known in the curtain-coating art. The fluid properties were a density of 1 gm/cc and a viscosity of 40 centipoise. Flow rate per unit width was 3.5 cc/sec per cm of curtain width. Under these conditions, the Reynolds number for the primary channel is 0.9 and has the preferred magnitude. Thus, good uniformity was achieved with a uniform gap. Reynolds numbers sufficiently higher or lower would have required tailoring the gap to achieve the desired uniformity in flow.

The invention has been described in detail with particular reference to certain preferred embodiments thereof, but it will be understood that variations and modifications can be effected within the spirit and scope of the invention.

What is claimed is:

1. A method of coating a surface with a curtain of coating composition comprising, supplying said coating composition to a basin for containing said coating composition, said basin having an outlet end and an inlet end; a supply conduit for transferring the coating composition to the inlet end of said basin; the outlet end of said basin being horizontal and configured to produce a uniform overflow of coating composition forming a free-falling curtain from said outlet end to said receiving surface; said inlet end configured to receive said coating composition from said supply conduit; said basin also having two endcaps determining the width of said free-falling curtain with a wall dividing said basin into a primary channel nearer said inlet end and a secondary channel nearer said outlet end, said wall extending across said basin from endcap to endcap and having one or more passageways such that the coating composition flows from said primary channel to said secondary channel either under the wall or through perforations in said wall wherein said coating composition is directed to an inlet enclosure positioned within said primary channel of said basin to receive said coating composition from said supply conduit, said inlet enclosure constituting a wall containing perforations configured to direct the coating composition towards said endcaps of said basin, said wall having a horizontal width equal to or greater than the diameter of said supply conduit, a vertical height extending from the bottom of said basin to the overflow edge of said outlet end of said basin, and a horizontal breadth equal to or less than the horizontal distance from the inlet end of said basin to said wall dividing said basin into said primary and secondary channels;

and directing said coating composition in a free-falling curtain to said receiving surface.

2. The coating method according to claim 1 further comprising the step of selecting the operating conditions such that the Reynolds number for said coating composition in said primary channel lies between 0.1 and 10.

3. The coating method of claim 1 wherein the top of the basin is open to the atmosphere.

4. The method according to claim 1 wherein the side of said inlet enclosure facing said wall has perforations.

5. A coating apparatus for coating compositions on a receiving surface comprising:

an open basin for containing said coating composition, said basin having an outlet end and an inlet end; a supply means for transferring the coating composition to the inlet end of said basin; the outlet end of said basin being horizontal and configured to produce a uniform overflow of coating composition forming a free-falling curtain from said outlet end to said receiving surface; said inlet end configured to receive said coating composition from said supply means; said basin also having two endcaps determining the width of said free-falling curtain;

a wall dividing said basin into a primary channel nearer said inlet end and a secondary channel nearer said outlet end, said wall extending across said basin from endcap to endcap and having one or more passageways such that the coating composition flows from said primary channel to said secondary channel either under the wall or through perforations in said wall, said primary channel comprising an inlet enclosure within said primary channel to receive said coating composition supplied to said inlet end of said basin, said inlet enclosure having a port to receive the coating composition, and said inlet enclosure configured to direct the coating composition toward said endcaps of said basin and to distribute the coating composition evenly across the cross section of said primary channel of said basin.

6. The coating apparatus according to claim 5, wherein said passageways through said dividing wall are gaps between said dividing wall and the bottom of said basin.

7. The coating apparatus according to claim 6, wherein said gap is single and continuous across the horizontal width of the basin.

8. The coating apparatus according to claim 7, wherein said single continuous gap varies in height or length between said endcaps of said basin.

9. The coating apparatus according to claim 5, wherein said dividing wall is partly or entirely perforated or porous to provide said passageways.

10. The coating apparatus according to claim 5, wherein said supply means is a conduit connecting with the inlet end of said basin.

11. The coating apparatus according to claim 10, wherein said conduit connection is centrally positioned with respect to the horizontal width of the basin.

* * * * *